US006474298B2

(12) United States Patent
Kanno

(10) Patent No.: US 6,474,298 B2
(45) Date of Patent: Nov. 5, 2002

(54) IDLE SPEED CONTROL VALVE CONTROL SYSTEM

(75) Inventor: Isao Kanno, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 2 days.

(21) Appl. No.: 09/725,540

(22) Filed: Nov. 29, 2000

(65) Prior Publication Data

US 2001/0001955 A1 May 31, 2001

(30) Foreign Application Priority Data

Nov. 30, 1999 (JP) ..... 11-341304

(51) Int. Cl.[7] ..... F02D 41/00
(52) U.S. Cl. ..... 123/339.14; 123/339.23
(58) Field of Search ..... 123/339.14, 339.23, 123/339.26, 327, 350, 361; 180/69.3; 440/87

(56) References Cited

U.S. PATENT DOCUMENTS 4,438,744 A * 3/1984 Hasegawa ..... 123/327
4,700,679 A * 10/1987 Otobe et al. ..... 123/327
5,074,810 A * 12/1991 Hobbs et al. ..... 440/2
5,113,347 A * 5/1992 Ohuchi et al. ..... 364/431.1
5,261,368 A 11/1993 Umemoto
5,289,807 A * 3/1994 Yonekawa ..... 123/325
5,586,534 A * 12/1996 Fujimoto ..... 123/325
5,630,394 A 5/1997 Grizzle et al.
5,701,867 A 12/1997 Mizutani et al.
5,934,247 A 8/1999 Hashimoto et al.
6,015,319 A * 1/2000 Tanaka ..... 440/84
6,029,624 A * 2/2000 Beechie et al. ..... 123/327
6,119,653 A 9/2000 Morikami

* cited by examiner

*Primary Examiner*—Willis R. Wolfe
*Assistant Examiner*—Mahmoud Gimie
(74) *Attorney, Agent, or Firm*—Knobbe Martens Olson & Bear LLP

(57) ABSTRACT

An outboard motor powers a watercraft and comprises an engine mounted within an engine compartment. The engine comprises an induction system having an induction passage extending between an air intake box to a combustion chamber. A throttle valve is positioned along the passage. A bypass passage communicates with the passage at a location between the throttle valve and the combustion chamber. An adjustable valve controls flow through the bypass passage. The adjustable valve can be closed at a first rate if a the watercraft is traveling at a speed greater than a preset value and at a second rate if the watercraft is traveling at a speed below the preset value.

19 Claims, 7 Drawing Sheets

IDLE SPEED CONTROL VALVE CONTROL SYSTEM

PRIORITY INFORMATION

This application is based on and claims priority to Japanese Patent Application No. 11-341304, filed Nov. 30, 1999, the entire contents of which is hereby expressly incorporated by reference.

BACKGROUND OF THE INVENTION

1 Field of the Invention

The present invention generally relates to idle speed controls for internal combustion engines used to power a watercraft. More specifically, the present invention relates to such systems in which throttle bypass levels are adjusted based upon the speed of the watercraft.

2 Related Art

Outboard motors are powered by engines contained within an engine compartment of the outboard motor. The outboard motors are conventionally attached to watercraft to power the watercraft in a forward or reverse direction. As is known, the engine of the outboard motor is subject to increased loading when compared to that of an automobile, for instance. This increased loading generally results from the nature of the outboard motor and the environment of use of the outboard motor.

The engines that power the outboard motors may contain an intake system featuring a bypass passage. The bypass passage typically is linked to the intake system upstream and downstream of a throttle control valve. As is known, the throttle control valve controls the amount of air flowing through the induction system into the engine for combustion. When the throttle control valve is closed, the air flow rate is minimized and when the throttle control valve is opened, the flow rate through the induction system can be somewhat controlled. The use of a bypass passage allows air to bypass the throttle control valve for supply to the engine even when the throttle control valve is closed. In some instances, an ISC, or idle speed control valve, is positioned along the bypass passage. The ISC valve can be used to fine tune the idling engine speed when the throttle control valve is in a closed position.

Conventional ISC valves are designed to open when the throttle valve suddenly closes following a period of high speed operation. It is thought that by opening the ISC valves when the throttle valve closes, misfiring and stalling can be obviated or greatly reduced. Generally speaking, the ISC valves are closed when the throttle valve is opened and when the engine speed is low. The ISC valves are opened when the throttle valve is closed and when the engine speed is high. In some applications, the ISC valves can be suddenly opened during high speed operation of the engine and then gradually closed after the engine speed decreases below a preset level.

The positioning of the idle speed control valve often is controlled by inexpensive step motors. The inexpensive step motors typically have a slow response characteristic. In other words, the command to move is followed by a slight delay before the movement occurs. In a conventional ISC valve control strategy, the ISC valve remains closed while the throttle valve is opening. The ISC valve remains in the closed position until the throttle angle is rapidly decreased (i.e., the throttle valve closes under the biasing force of a spring, such as when the opening force provided by an operator controlled actuator is removed). Once the throttle angle is rapidly decreased, the ISC valve slowly opens under the control of the stepper motor. Because of the slow opening rate of the idle speed control valve, the air flow through the induction system does not properly match the desired change of the engine speed resulting from the rapid change in a throttle opening position. Accordingly, the engine can stall or misfire due to an inadequate supply of intake air. One way of correcting this is to provide an idle speed control valve in which the ISC valve opens more rapidly for each input signal to the stepper motor. A drawback from this approach is that a large ISC valve is required and the larger ISC valves increase cost and weight.

Another solution to the misfiring and stalling of the engine is to make the ISC valve more accurately follow the changes in a throttle angle and consequently the engine speed. Preferably, this arrangement would result in the ISC valve being maintained in an open position while the throttle angle is open. This arrangement ensures that a more-than-adequate air supply is provided when the throttle angle is rapidly decreased. The ISC valve then can close with the throttle valve. It should be noted, however, that if the closing speed of the ISC valve is too rapid, the engine speed can overshoot and hunt. Closing the ISC valve too rapidly can also cause the engine speed to rapidly decrease, which can produce excessive loads within the engine and cause the engine to stall. On the other hand, if the closing speed of the ISC valve is too slow, the engine speed decreases too slowly. Moreover, when the transmission is in the forward drive position, the advancing force of the watercraft, which drives the propeller, can further slow the engine speed decrease. As a result, the watercraft is not as responsive to changes in operator demand. The slow decrease in engine speed also makes it difficult to shift gears, especially from a forward position to a neutral position.

Accordingly, an arrangement is desired such that, when throttle valve suddenly closes, the watercraft is sufficiently responsive to changes in the operators demand, the engine speed does not hunt and the engine does not stall.

SUMMARY OF THE INVENTION

Accordingly, an idle speed control system is desired in which an idle speed control valve is opened as a throttle valve is opened and in which the idle speed control valve is closed at different rates, which are dependent upon the speed of the watercraft, when the throttle valve is rapidly closed.

One aspect of the present invention involves an engine for a watercraft that includes a cylinder body and at least one cylinder bore being formed in the cylinder body. A piston is mounted for reciprocation within the cylinder bore. A cylinder head is disposed over a first end of the cylinder bore. A crankcase member is disposed over a second end of the cylinder bore and an output shaft is disposed at least partially within a crankcase chamber at least partially defined by the crankcase member. The output shaft powers an output device. A combustion chamber is defined at least partially within the cylinder bore between the cylinder head and the piston. An intake conduit communicates with the combustion chamber. A throttle valve is disposed within the intake conduit. A throttle valve sensor is capable of sensing a position of the throttle valve. A bypass passage communicates with the intake conduit at a location between the throttle valve and the combustion chamber. An idle speed control valve is disposed along the bypass passage. A speed sensor is capable of deducing a traveling speed of the watercraft. A controller is electrically communicating with the idle speed control valve, the speed sensor and the throttle valve sensor. The controller is adapted, when the throttle valve is rapidly closed, to close the idle speed control valve a first rate when the watercraft is traveling at a speed greater than a preset value and a second rate when the watercraft is traveling below the preset value.

Another aspect of the present invention involves a method of controlling the movement of an idle speed control valve. The method comprises detecting a throttle angle, sensing a position of the idle speed control valve, determining a target position of the idle speed control valve position, comparing the target position to the sensed position, sensing a speed of a watercraft, moving the idle speed control valve at a first rate if the target position and the sensed position differ and the speed of the watercraft is above a preset value and moving the idle speed control valve at a second rate if the target position and the sensed position differ and the speed of the watercraft is below the preset value.

A further aspect of the present invention involves a method of controlling an idle speed control valve in an engine for a watercraft. The method comprises sensing a throttle angle, sensing a traveling speed of the watercraft, moving the valve at a first rate if the traveling speed of the watercraft is above a preset value and moving the valve at a second rate if the traveling speed of the watercraft is below the preset value.

BRIEF DESCRIPTION OF THE DRAWINGS

These and other features, aspects and advantages of the present invention will now be described with reference to the drawings of several preferred embodiments, which embodiments are intended to illustrate and not to limit the invention, and in which figures.

DETAILED DESCRIPTION OF THE PREFERRED EMBODIMENTS OF THE INVENTION

Figure 1:
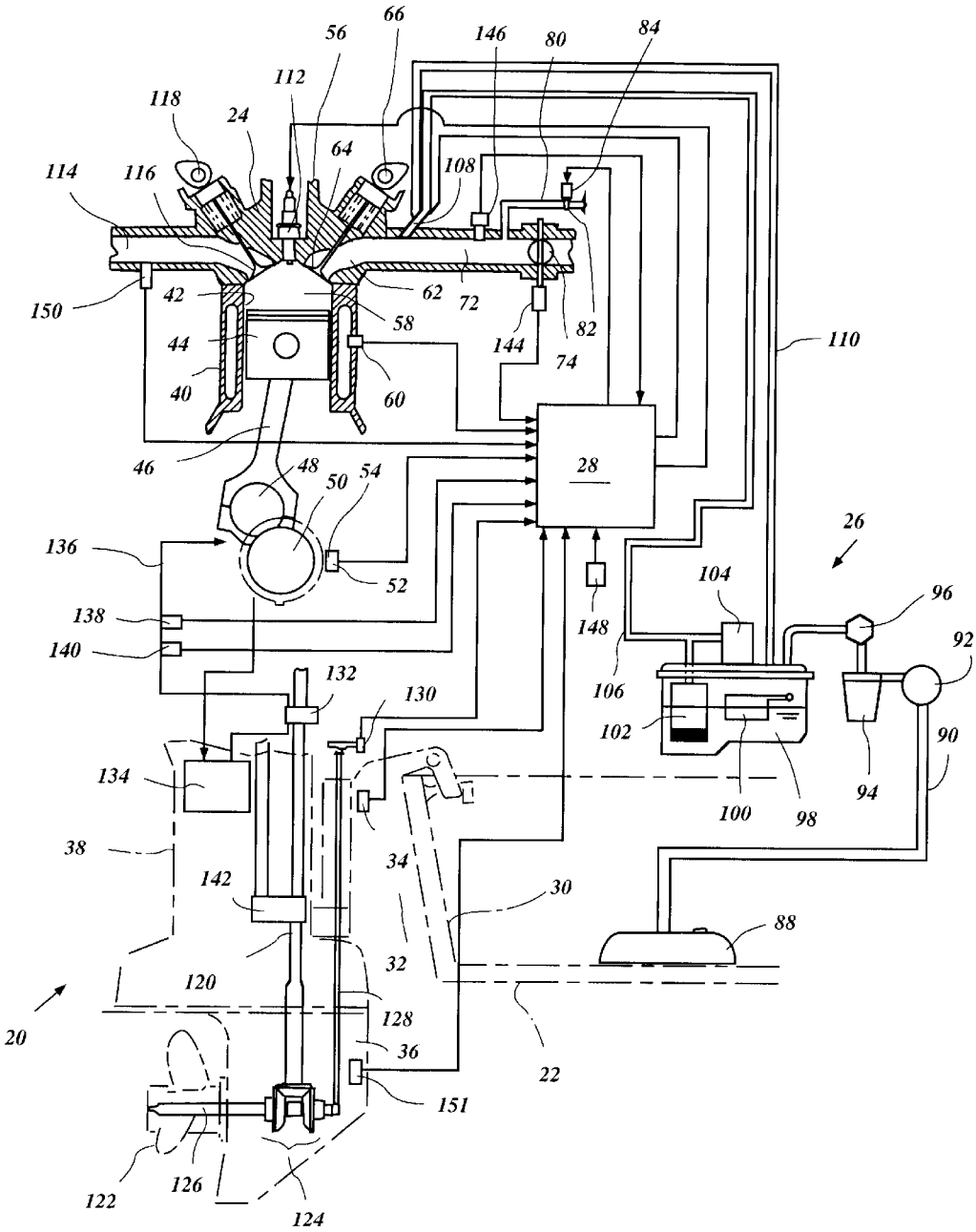
FIG. 1 is a schematic illustration of an engine and a portion of a watercraft shown in phantom having a control system arranged and configured in accordance with certain features, aspects and advantages of the present invention.

With reference now to FIG. 1, a portion of an outboard motor 20 attached to a watercraft 22 is illustrated. In addition, in FIG. 1, a portion of an engine 24 is shown in schematic cross-section. Furthermore, a portion of a fuel supply system 26, portions of the outboard motor 20, the engine 24 and the fuel system 26 are interconnected by an ECU or other suitable controller 28. While the present invention will be described in the context of an outboard motor that is attached to a watercraft, it should be apparent to those of ordinary skill in the art that the present invention can be used in other environments. For instance, the present invention may find utility in personal watercraft, small water vehicles, jet boats and the like. In particular, due to the unique operating characteristics of water vehicles, the present invention is particularly designed for use in such applications.

With continued reference to FIG. 1, the outboard motor 20 is attached to a transom 30 of the watercraft 22. In the illustrated arrangement, the outboard motor 20 is attached to the transom 30 through the use of a mounting bracket 32. Any suitable mounting bracket 32 can be used to attach the outboard motor 20 to the watercraft 22. The mounting bracket 32 preferably allows the outboard motor 20 to be tilted and trimmed about a generally horizontal axis and preferably allows the outboard motor 20 to be steered about a generally vertical axis. Such arrangements are well known to those of ordinary skill in the art.

In the illustrated arrangement, an outboard motor position sensor 34 is connected to the outboard motor 20 and to the ECU 28 to provide a signal to the ECU 28 which is indicative of a relative positioning of the outboard motor 20 and the watercraft 22. In the illustrated arrangement, the position sensor 34 is hardwired to the ECU 28. It is anticipated that any number of quick disconnect electrical couplings can be provided between the sensor 34 and the ECU 28. In addition, it is anticipated that the connection between the sensor 34 and the controller 28 can have any suitable configuration. For instance, but without limitation, the two components can be connected by a physical wire, by infrared signals, by radio waves or in any other suitable manner. Of course, other sensors will be described below and such interconnections can be used with any of the sensors and the ECU 28. Moreover, the ECU 28 preferably is designed to control various valves, injectors and ignition systems through the use of a variety of control signals. The control signals can be sent between the ECU 28 and the receptor component in any of these manners as well.

The outboard motor 20 in the illustrated outboard motor 20 generally comprises a lower unit 36 and a driveshaft housing 38. While not shown, a powerhead can be positioned above, and can be supported by, the driveshaft housing 38. The powerhead generally comprises a protective cowling which encases the engine 24 and provides a protective environment in which the engine can operate.

The engine 24 preferably is of the four-cycle, multi-cylinder type. In some arrangements, the engine 24 can comprise six cylinders arranged in two banks in a V-6 configuration. In other arrangements, such as that illustrated schematically in FIG. 2, the engine 24 comprises four cylinder bore arranged inline in a single bank. It should be noted that the present invention may find that some utility with engines having other operating principles. For instance, some of the features of the present invention may find applicability to two-stroke and rotary-type engines.

With continued reference to FIG. 1, the illustrated engine preferably comprises a cylinder block 40 in which one or more of the cylinder bores 42 are defined. It is anticipated that the cylinder block 40 can be replaced by individual cylinder bodies that define the cylinder bores 42. In addition, the cylinder bores 42 may receive a sleeve or other suitable treatment to reduce friction between the cylinder block 40 and a piston 44, which is arranged for reciprocation within the cylinder bore 42.

The piston 44 is mounted for reciprocation within the cylinder bore 42. The piston 44 is connected by a connecting rod 46 to a throw 48 of a crankshaft 50. As the piston 44 is driven up and down within the cylinder bore 42, a crankshaft 50 is driven for rotation about a rotational axis. A suitable speed sensor 52 preferably is provided to sense the engine speed, as indicated by the rotational speed of the crankshaft 50. In the illustrated arrangement, a pulsar coil 54 is connected to the crankshaft 50 and the speed sensor 52 operates to detect the rotational speed of the pulsar coil. The signals generated by the speed sensor 52 are then transmitted to the ECU 28 for use in manners which will be described.

A cylinder head assembly 56 preferably is positioned atop of the cylinder block 40. The cylinder head 56, in combination with the piston 44 and the cylinder bore 42, defines a combustion chamber 58. It should be noted that the cylinder block 40 in the illustrated arrangement contains a sensor 60 which outputs a signal indicative of a temperature of coolant flowing through a cooling jacket associated with the cylinder block 40. Of course, the sensor 60 can be positioned in other positions such that it outputs a signal indicative of an operating temperature of the engine 24 to the ECU 28.

An intake passage 62 is defined through a portion of the cylinder head 24. In some arrangements, more than one intake passage 62 may be defined through the cylinder head 24 into the combustion chamber 58. An intake control valve 64 can be designed to control the flow of intake air through the passage 62 into the combustion chamber 58. Movement of the intake valve 64 is controlled, in the illustrated arrangement, with a cam shaft 66. Such arrangements are well known to those of ordinary skill in the art.

Figure 2:
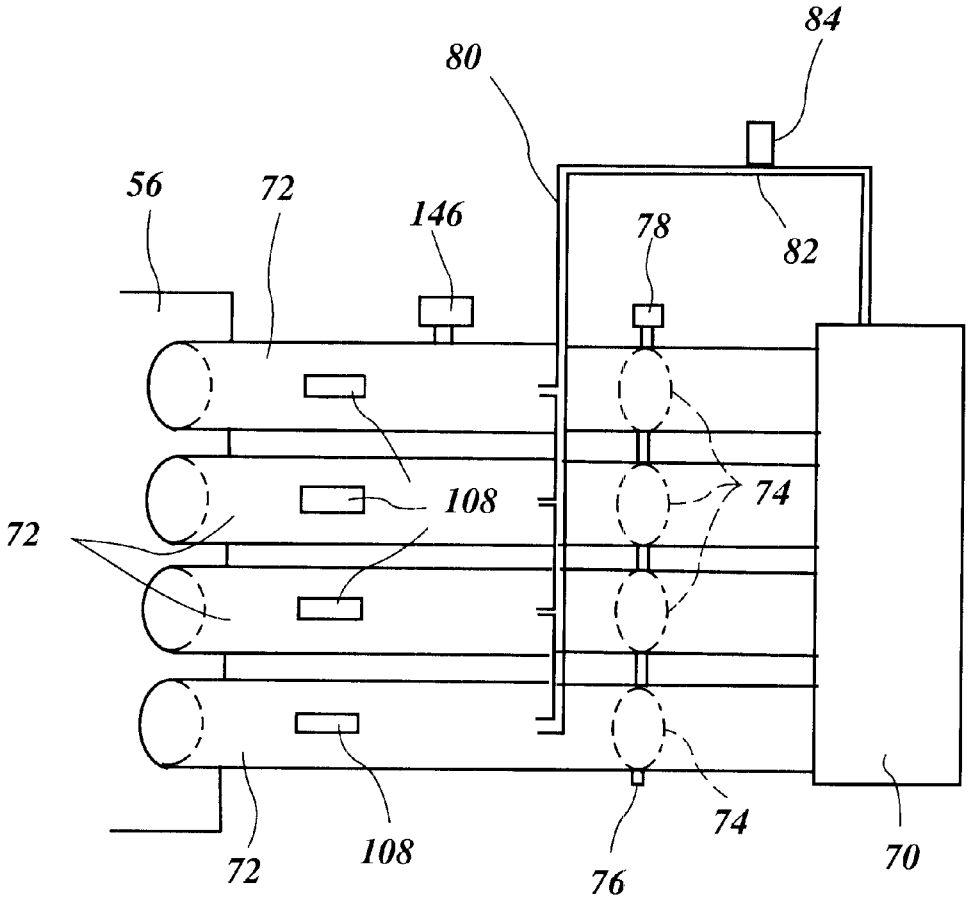
FIG. 2 is a schematic illustration of an induction system featuring a bypass passage.

With reference now to FIG. 2, air is inducted into the induction system through an air intake box 70. The air drawn into the air intake box 70 is passed to the combustion chamber 58 via a set of intake pipes 72. The intake pipes 72 extend between the air box 70 and the associated intake passages 62 for each individual combustion chamber 58. Flow through the intake pipes 72 is controlled through the use of a throttle valve 74. In the illustrated arrangement, a number of throttle valves 74 are positioned on a single rod 76 and are controlled with a single actuator 78. The actuator 78 controls the movement of the valves 74 about a rotational axis in response to changes in operator demand. The operator can change the positioning of the throttle valves 74 by operating an accelerator pedal or an accelerator lever in any manner well known to those of ordinary skill in the art. Of course, the throttle valves can be separately controlled or a single throttle valve can control the flow through the entire induction system.

In the illustrated arrangement, a bypass passage 80 is provided between or the intake box 70 and the individual runners 72 extending to the cylinder head 56. The bypass passage 80 is designed to communicate with each of the illustrated intake runners 72. The bypass passage 80 opens into the individual runners 72 downstream of the throttle control valve 74 such that when the throttle control valves 74 are closed, air may be supplied to the intake runners 72 through the bypass passage 80 under the control of an idle speed control valve 82. In some arrangements, multiple valves 82 can be provided to correspond with the multiple runners 72. The idle speed control valve 82 can be opened and closed to vary the level of flow through the associated bypass passage 80.

The idle speed control valve 82 can be moved using an actuator 84 associated with the valve 82, which will be described in more detail below. In the illustrated arrangement, the actuator 84 comprises a stepper motor. In some configurations, however, the actuator 84 may comprise a solenoid or other suitable actuator mechanism. In the illustrated arrangement, the actuator 84 is connected to the ECU 28 to receive signals from the ECU 28 that are generated in accordance with certain features, aspects and advantages of the present invention.

With reference to FIG. 1, air inducted through the induction system is mixed with fuel provided through the fuel supply system 26. In the illustrated arrangement, the fuel supply system 26 draws fuel from a fuel tank 88 that is positioned within the watercraft 22 in the illustrated arrangement. The fuel is drawn from the fuel tank 88 through a supply line 90 with a first low pressure fuel pump 92. In some arrangements, the low pressure fuel pump 92 may be driven by pressure variations within the crankcase. The fuel is drawn by the fuel pump 92 and supplied to a fuel filter 94 in manners well known to those of ordinary skill in the art. In addition, fuel from the fuel filter 94 is drawn by a second low pressure pump 96 for deposit into a vapor separator 98. The vapor separator 98 preferably includes a float 100 that operates to control the level of fuel within the vapor separator 98 at any given moment.

A fuel pump 102 is provided within the vapor separator 98 to provide fuel from the vapor separator 98 to the engine for combustion. In the illustrated arrangement, a pressure regulating fuel return 104 is provided. The pressure regulating fuel return 104 returns fuel when the pressure within a fuel supply line 106 exceeds a preset level.

The fuel through the fuel supply line 106 is supplied under high pressure to a fuel injector 108. The fuel injector 108 in the illustrated arrangement is designed for indirect injection. That is, the fuel injector 108 injects fuel into the induction system at a location outside of the combustion chamber 58. In some arrangements, however, the fuel injector 108 may be disposed for injection directly into the combustion chamber 58.

Fuel may be bypassed from the fuel injector 108 through a return line 110. The return line 110 maintains a flow of fuel between the vapor separator 98 and the fuel injector 108. The flow of fuel decreases the influence of combustion heat generated within the combustion chamber 58 upon the fuel and reduces vaporization of fuel. In addition, by returning the fuel to the vapor separator 98, the pressure of the fuel supplied to the fuel injector 108 can be controlled. Of course, the fuel injector 108 can be controlled using the ECU 28 in a manner known to those of ordinary skill in the art. This is represented by the control signal illustrated in FIG. 1.

The air fuel mixture drawn into the combustion chamber 58 can be ignited through the use of any suitable ignition component 112. In the illustrated arrangement, a sparkplug 112 is disposed with an electrode positioned within the combustion chamber 58. The sparkplug 112 can be fired in accordance with any suitable ignition strategy and in the illustrated arrangement, is controlled through the ECU 28.

Following combustion, the exhaust gases can be removed from the combustion chamber 58 through an exhaust passage 114 that extends from the cylinder head 56. The exhaust passage 114 includes at least one exhaust port that is disposed in the cylinder head 56 adjacent to the combustion chamber 58.

An exhaust control valve 116 controls the opening and closing of the exhaust port to allow exhaust gases to flow from the combustion chamber 58. The exhaust control valve 116 is opened and closed with an exhaust cam shaft 118 or in any other suitable manner. The exhaust gases then can be transferred from the exhaust passage 114 to the atmosphere or body of water in which the watercraft is operating in any suitable manner. For instance, in some arrangements, the exhaust gases may be routed through the driveshaft housing 38 into the lower unit 36 and out through a through-the-hub discharge.

Rotational power from the crankshaft 50 preferably is provided to a driveshaft 120. The driveshaft 120 is used to power an output device such as a propeller 122. In the illustrated arrangement, a forward-neutral-reverse bevel gear transmission 124 is interposed between the driveshaft 120 and a propeller shaft 126. The propeller shaft 126 is splined or otherwise suitably connected to the propeller 122. Movement of the propeller 122 also can be controlled by the transmission 124 in any other suitable manner.

In the illustrated arrangement, a shift rod 128 is provided to shift the transmission 124 between forward, neutral and reverse. A position sensor 130 is provided that emits a signal to the ECU 28. The signal indicates a relative position of the transmission 124. For instance, the signal may indicate that the transmission is in a forward position, a reverse position or a neutral position. In some configurations, the signal may indicate that the transmission is either engaged or disengaged. In other words, the signal may indicate that the transmission is in a forward or reverse state or, alternatively, that the transmission is disengaged and in a neutral state.

Several other components also can be driven by the driveshaft 120. In the illustrated arrangement, a lubricant pump 132 is provided. The lubricant pump 132 draws lubricant from a lubricant reservoir 134. The lubricant from the reservoir 134 is provided to the engine 24 for lubrication through a supply line 136. Preferably, a variety of sensors are provided in a lubrication system to indicate an operational state of the lubrication system. For instance, in the illustrated arrangement, a pressure sensor 138 as well as a temperature sensor 140 are provided. These sensors 138, 140 provide signals to the ECU 28.

In addition, the driveshaft 120 powers a water pump 142. The water pump 142 draws cooling water from within the body of water in which the watercraft is operating and provides it to the engine and various other components. In the illustrated arrangement, the coolant provided by the cooling pump 142 can be provided to a variety of cooling jackets. In this manner, the coolant can cool the engine as well as various operating components related to the engine and the watercraft and can be returned to the body of water in which the watercraft is operating. Of course, in some arrangements, a reservoir containing coolant can be provided from which the coolant is drawn and returned.

The illustrated arrangement also features a number of other sensors that communicate with the ECU 28. For instance, a throttle valve position sensor 144 is provided that emits a signal indicative of the positioning of the throttle valves 74. The signal may indicate the percentage opening of the throttle valves. For instance, a throttle valve that is 0% open is closed. While a throttle valve that is 80% open is substantially wide open. The illustrated ECU 28 also communicates with an induction pressure sensor 146. The induction pressure sensor 146 can be arranged to detect the pressure within an induction system associated with the engine 24. In some arrangements, a sensor 146 may be provided to a single runner 72 or may be provided to each runner 72 individually. Moreover, the ECU 28 receives a signal from an atmospheric pressure sensor 148. The atmospheric pressure sensor 148 communicates with the ECU 28 and provides a signal indicative of the pressure in the environment in which the watercraft is operating. An oxygen detection sensor 150 may be provided in the exhaust system to indicate an operational status of the engine 24. The oxygen detection sensor can be used to detect how complete combustion is within the combustion chamber 58 in any manner known to those of ordinary skill in the art. A suitable watercraft speed sensor 151 preferably is provided on the lower unit 36 of the outboard motor 20 for sensing the speed of the watercraft 22. The speed sensor 151 can be of any known type, such as, for example a pitot tube or an impeller type speed sensor. Additionally, the speed sensor 151 can be mounted to a surface or portion of the watercraft 22 on which the motor 20 is mounted.

Figure 3:
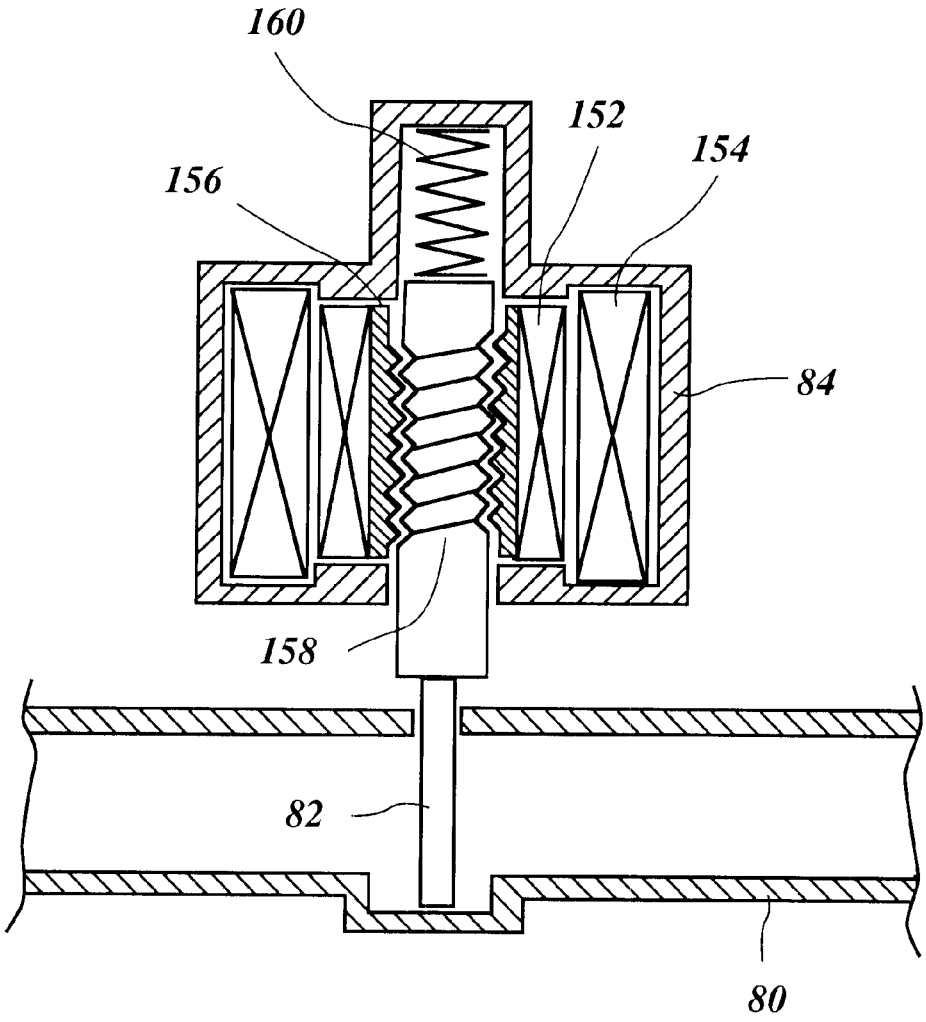
FIG. 3 is a schematic illustration of a section of an idle speed control valve arranged and configured in accordance with certain features, aspects and advantages of the present invention.

With reference now to FIG. 3, an exemplary idle speed control valve 82 ("ISC valve") is illustrated therein. In the illustrated arrangement, the actuator 84 comprises a rotor 152 and a stator 154. Preferably, the rotor and the stator are components of a stepper motor. While the present invention will be described as using a stepper motor as the actuator, solenoids and other suitable actuators also can be used.

The rotor 152 preferably comprises a threaded inner surface 156 that mates with a threaded outer surface 158 that is connected to the valve 82. In addition, a biasing member 160, or spring in the illustrated arrangement, biases against a portion of the valve 82. As the rotatable member or rotor 152 rotates relative to the stator 154, the idle speed control valve 82 is extended into and retracted out of the passage defined by the bypass passage 80. In other words, a first direction of rotation of the rotor 152 relative to the stator 154 drives the valve 82 downward while a second direction of rotation drives the valve upward. Of course, upward and downward are relative to the figure and should not limit the present invention. The biasing member 160, which in the present arrangement happens to be a spring but need not be, urges the valve in a downward orientation to reduce the likelihood that the valve 82 is stuck in a retracted position.

Preferably, the valve is moved from a closed position to an open position over time. A number of steps are required to move the valve between the two positions. The steps are separated by time and the movements occur quite rapidly in each step. The result is a very controlled movement of the valve between a closed and an open position and vice versa. The downside to the controlled movement, however, is that the movement tends to be relatively slow.

Figure 4:
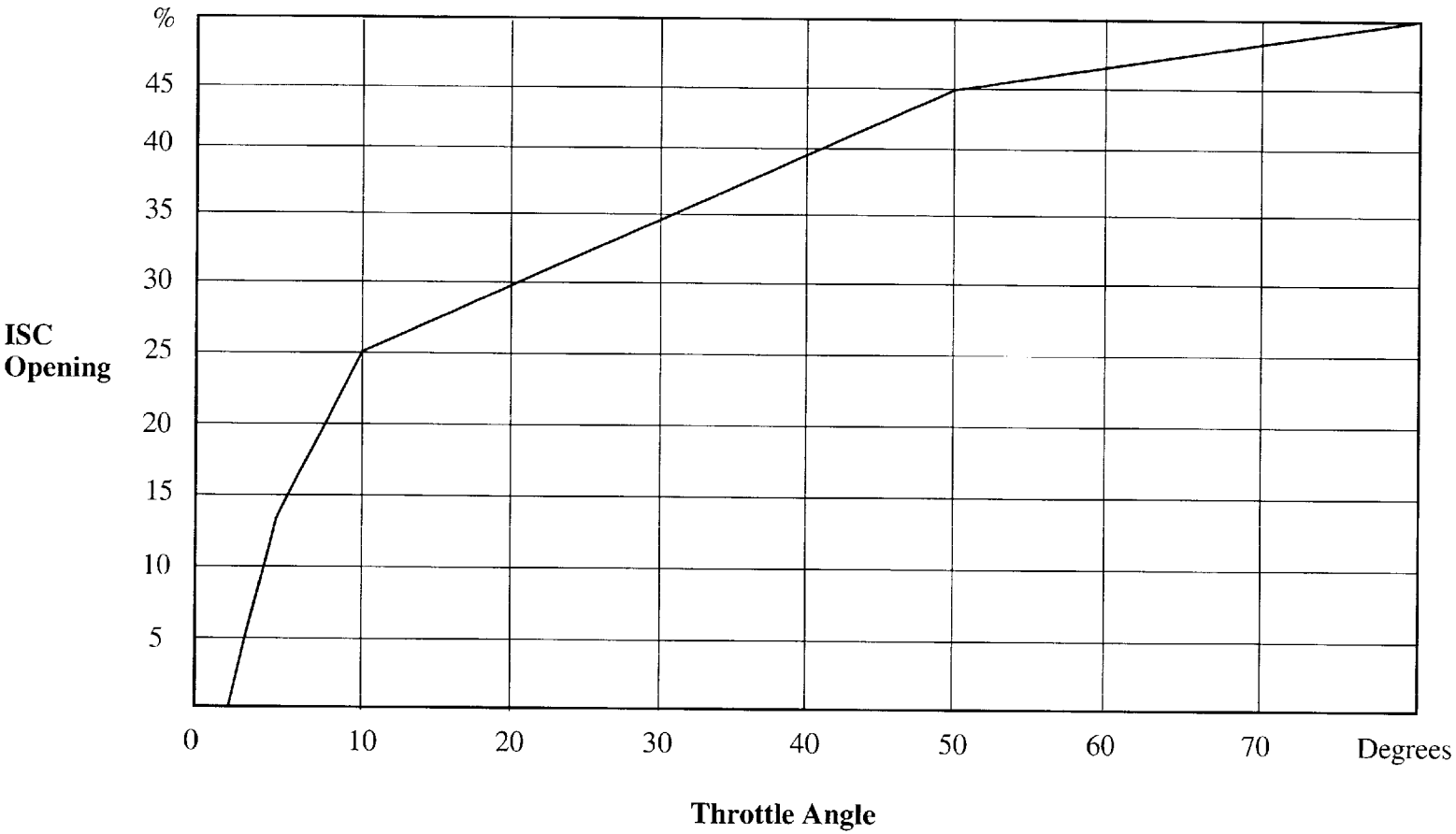
FIG. 4 is a graphical depiction of an idle speed control valve opening position relative to a throttle angle illustrating a controlled opening of the idle speed control valve in response to an opening of the throttle valve.

With reference now to FIG. 4, a graphical illustration of the idle speed control valve opening percentage relative to the throttle angle is presented. As illustrated in this exemplary embodiment, the idle speed control valve preferably is controllable opened as a throttle angle is opened. In other words, while the throttle angle is slowly opened from a closed position to a wide open position, the ISC valve is similarly opening with the largest amount of opening occurring during about the first 10° of throttle movement. Advantageously, this allows the idle speed control valve to open during just a slight advancement of the throttle angle. As can be seen from the graphical depiction of FIG. 4, the ISC valve continues to open at a slightly less rapid rate between about 10° and about 50° of throttle angle. In this configuration, the ISC valve maintains a steady opening rate while the throttle angle is opened from about 10° to about 50°. After about 50° of throttle angle, however, the opening of the ISC valve greatly decreases in the illustrated arrangement. The opening of the ISC valve advantageously is controlled based upon the positioning of the throttle valve.

Figure 5:
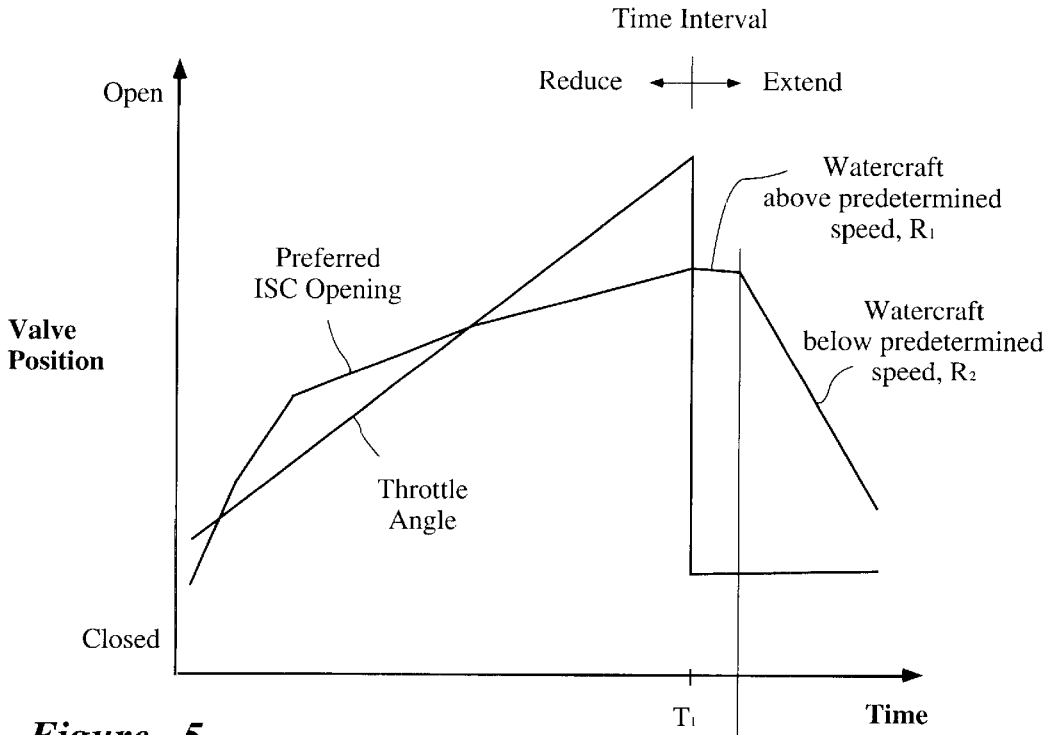
FIG. 5 is a graphical depiction of an idle speed control valve control arrangement having certain features, aspects and advantages in accordance with the present invention.

With reference now to FIG. 5, a graphical depiction of a control arrangement having certain features, aspects and advantages of the present invention is illustrated therein. In this arrangement, the ISC valve is being opened while the throttle angle is increasing. In other words, while the throttle valve is being opened, the ISC valve also is being opened. As indicated in FIG. 4, the ISC valve opens more quickly or more rapidly during the first portions of throttle valve movement. For instance, the ISC valve and the throttle valve are opened over time. At a particular moment in time, T1 in the illustrated arrangement, the throttle valve is rapidly closed. By rapidly closed, it is intended to mean that the biasing force holding open the throttle valve is removed or that the throttle valve is returned to a closed position under the control of a return spring rather than being slowly released under operator control. This is meant to differentiate between a controlled throttle angle decrease, such as when the operator slowly decreases the throttle angle, and a rapid throttle angle decrease, wherein the operator simply releases the actuator member controlling the throttle valve.

Figure 6:
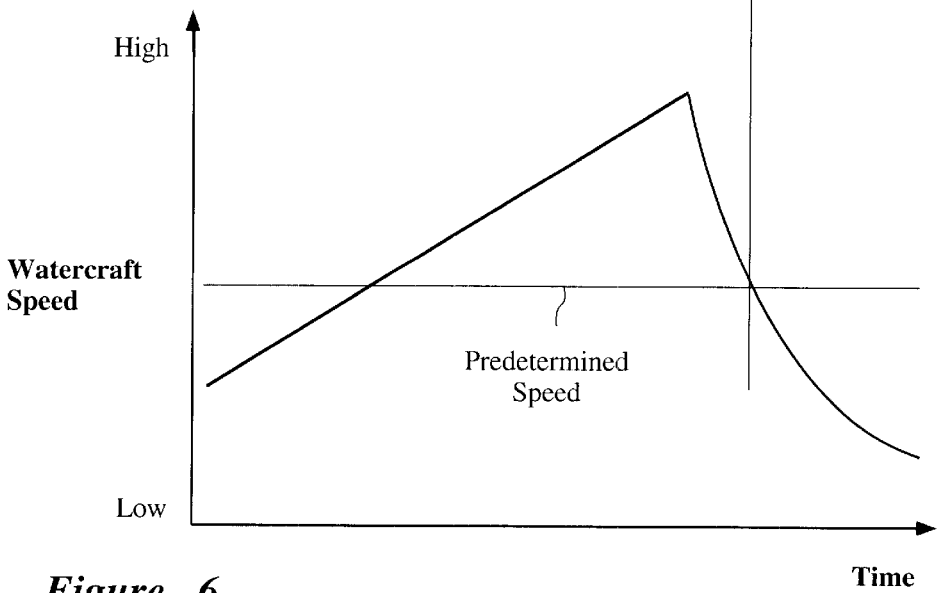
FIG. 6 is a graphical depiction of watercraft speed over time during a controlled movement of an idle speed control valve arranged and configured in accordance with certain features, aspects and advantages of the present invention.

In the illustrated arrangement, when the throttle valve angle rapidly decreases, the ISC valve is slowly closed under the control of the actuator 84. One aspect of the present invention is that the rate of closure of the ISC valve 82 differs depending upon the speed of the watercraft 22. Specifically, when the watercraft 22 is traveling at a speed above a preset value, the ISC valve closes at first rate $R_1$. Correspondingly, when the watercraft 22 is traveling at a speed below a preset value, the ISC valve is closes at a second rate $R_2$. Preferably, the second rate $R_2$ is greater than the first rate $R_1$. In some arrangements, the first rate $R_1$ could be zero or about zero such that the ISC valve is fixed in position. Accordingly, the ISC valve closes faster when the watercraft 22 is traveling at a speed below a preset value as compared to when the watercraft 22 is traveling at a speed above a preset value. This is illustrated in the graphical depiction of FIG. 5. The net result of varying the closure rate depending upon whether the watercraft is traveling above or below a preset value can be viewed in the graphical depiction of FIG. 6. In this arrangement, it can be seen that there is very little engine hunting and the engine speed decreases smoothly and quickly.

Figure 7:
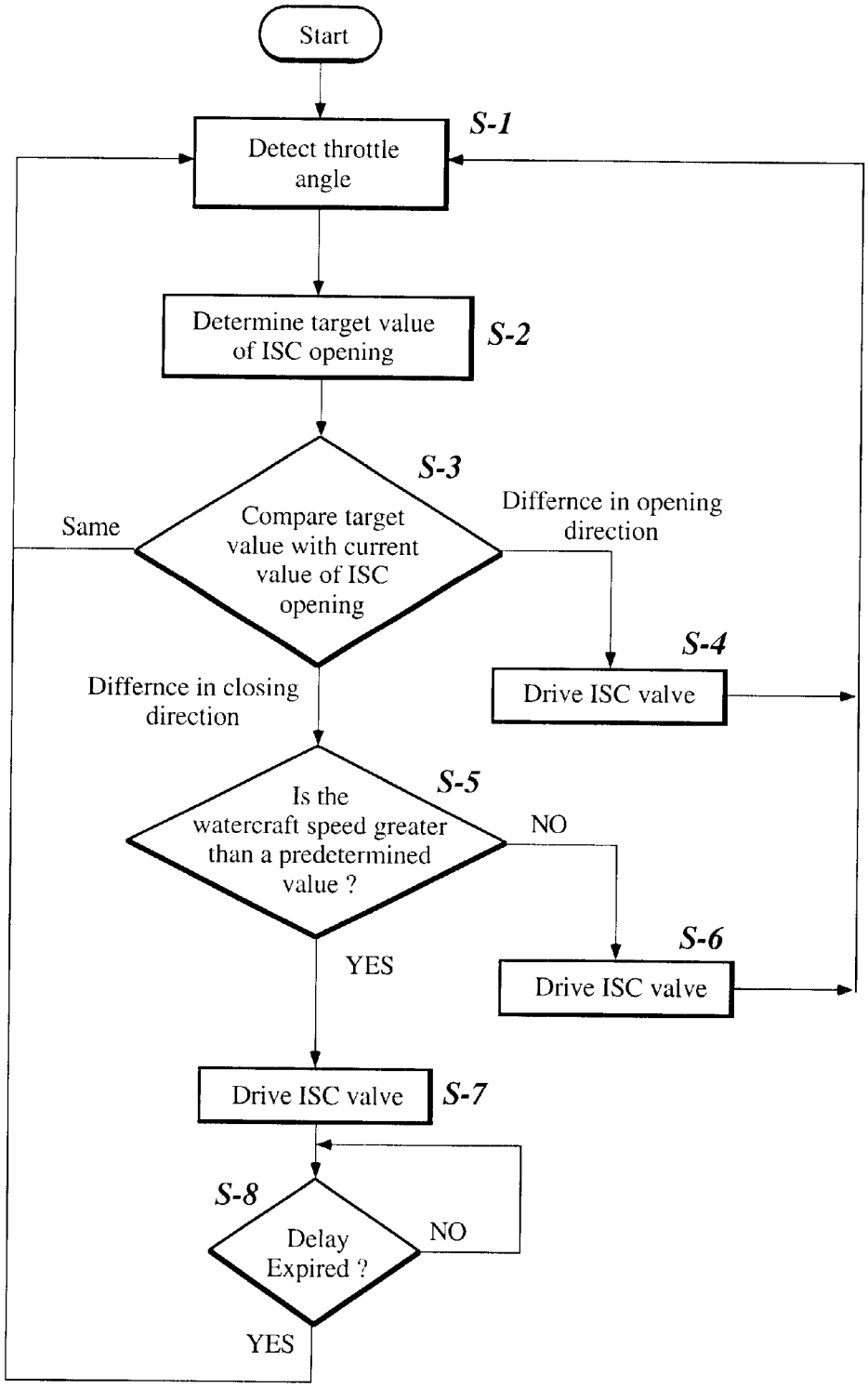
FIG. 7 is a flow diagram illustrating a control routine having certain features, aspects and advantages in accordance with the present invention.

With reference now to FIG. 7, a control routine that is capable of implementing a control strategy that achieves control similar to that described graphically in FIG. 5 is illustrated therein. The routine begins by detecting a throttle angle (see S-1). After the throttle angle has been detected, a target value of the ISC valve opening is determined (see S-2). This determination is based at least in part upon the throttle angle which has been detected in the illustrated arrangement. In particular, the target value of the ISC valve opening can be chosen based upon a preprogrammed control map, such as the one illustrated in FIG. 4, in which the ISC valve opening is related to the throttle angle.

After determining the target value of the ISC valve opening, the target value is compared with the currently sensed value of the ISC valve opening position (see S-3). If the target value and the current value are the same, then the routine begins again by detecting the throttle angle. If the target value is different from the current value and the difference is in the opening direction (i.e., the target ISC position is greater than the sensed ISC position), the ISC is driven to the targeted value (see S-4) and the routine begins again by detecting the throttle angle. However, if the target value is different from the current value in the closing direction (i.e., the target ISC position is less than the sensed ISC position), the controller determines if the watercraft is traveling at a speed greater than a preset value. It should be noted that determining whether the valve needs to be opened or closed can be performed in other suitable manners. For instance, each opening signal can be stored and each closing signal can be stored in representative indexes. Subtracting one index value from the other can provide information about the degree to which the valve has been opened or closed. This information also can be used to provide information regarding the current position of the valve. In the illustrated arrangement, determining whether the watercraft is traveling at a speed greater than a present value is performed by detecting a signal from the watercraft speed sensor 151, which is indicative of the speed of the watercraft 22. Of course, other manners of detecting the speed of the watercraft 22 can be used. The sensed water speed is compared to the preset value, which is preferably stored in the memory of the ECU 28.

The determination of whether the watercraft is traveling at a speed greater than or less than a preset speed (see S-5) is used to control the movement of the ISC valve. In the event that the watercraft is traveling at a speed below the preset value, then the ISC valve is moved (see S-6) and the routine begins again by detecting the throttle angle. However, if the water craft is traveling at a speed above the preset value, then the ISC valve is moved and the routine delays before again detecting the throttle angle (see S-7, S-8). Accordingly, due to the delay that is imposed when the watercraft is traveling at a speed greater than the preset value, movement of the ISC valve is more rapidly performed when the watercraft is traveling at a speed below the preset value than when the watercraft is traveling at a speed above the preset value. It should be appreciated that in a modified arrangement the ISC valve can be moved after the routine delays when the watercraft is traveling at a speed above the preset value. However, the illustrated arrangement is advantageous because it positions the valve position closer to the desired position during the delay.

Figure 8:
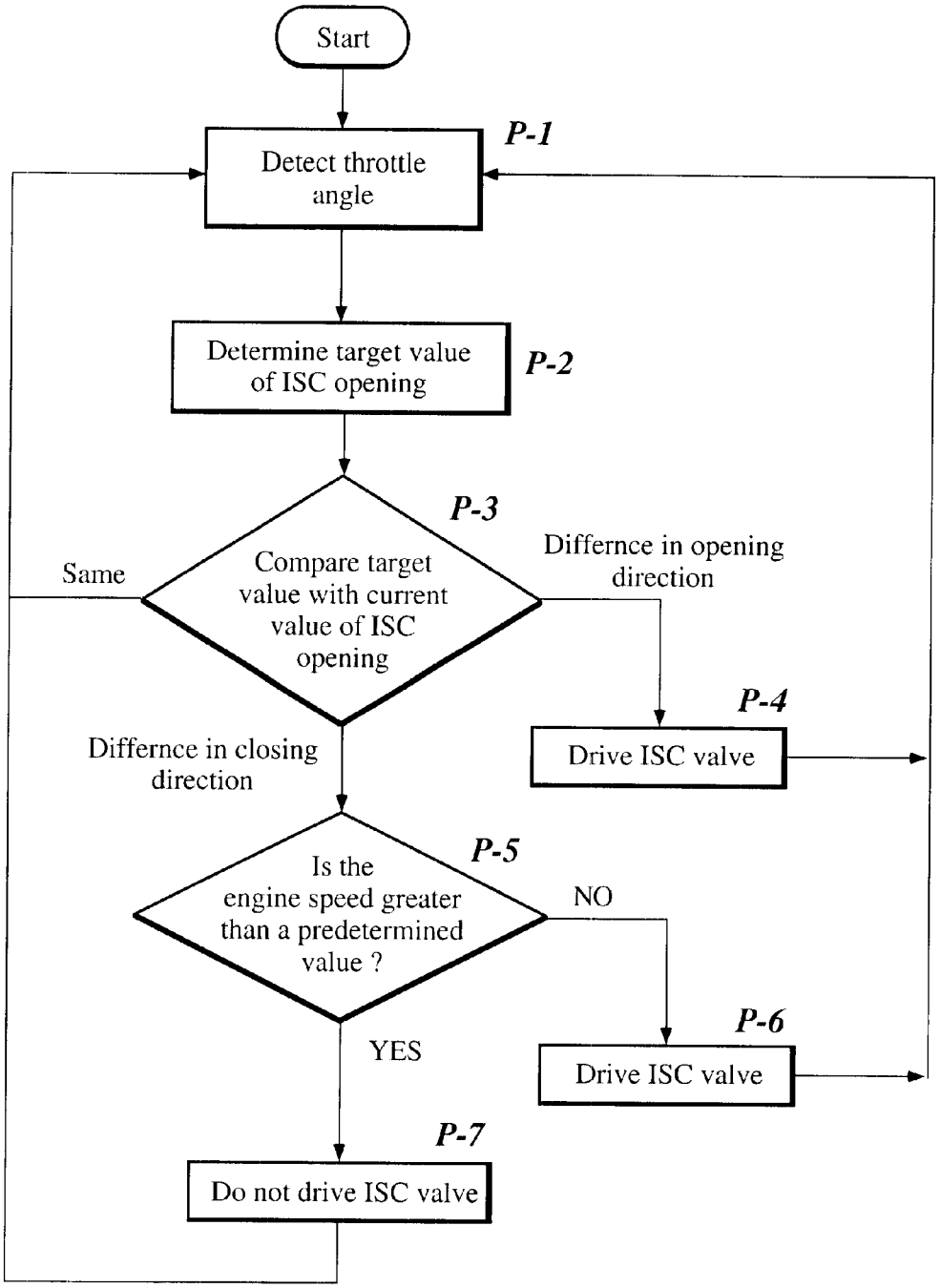
FIG. 8 is a flow diagram of another control routine also having certain features, aspects and advantages in accordance with the present invention.

With reference now to FIG. 8, another arrangement of a control system is illustrated therein. In this arrangement, the throttle angle is detected (see P-1) and the target value of the ISC valve opening is determined (see P-2). The controller compares the target value with the current value of the ISC valve opening (see P-3). If the target value and the current value are the same, then the routine begins again by detecting the throttle angle.

If the target value is different from the current value and the difference is in the opening direction (i.e., the target ISC position is greater than the sensed ISC position), the ISC valve is driven to the targeted value (see P-4) and the routine begins again by detecting the throttle angle. However, if the target value is different from the current value in the closing direction (i.e., the target ISC position is less than the sensed ISC position), the controller determines if the engine speed is greater than a preset value (see P-5). Accordingly, in this arrangement, the speed of the watercraft is estimated from the speed of the engine, which in the illustrated embodiment is detected by the engine speed sensor 52. Accordingly, in this arrangement, the watercraft speed sensor 151 is not necessary.

The determination of whether the engine speed is greater than or less than a preset speed (see P-5) is used to control the movement of the ISC valve. In the event that the engine speed is below the preset value, then the ISC valve is moved (see P-6) and the routine begins again by detecting the throttle angle. However, in the illustrated arrangement, if the engine speed is above the preset value, then the ISC valve is not moved (see P-7) and the routine loops back to again detect the throttle angle. Accordingly, movement of the ISC valve is more rapidly performed when the engine speed is below the preset value as compared to when the engine speed is above the preset value.

The present invention provides control routines that more rapidly closes the idle speed control valve during rapid deceleration of the engine if the watercraft is traveling at a speed below a preset value or if the engine speed is below a preset value. This accounts for the changes in loading upon the engine which can cause vast operating differences in engines used for powering watercraft, such as outboard motors, stem drives or engines used within personal watercraft. Accordingly, this arrangement accounts for the changes in load upon the engine, as well as rapid decreases in engine speed, to reduce or minimize engine hunting, stalling and misfiring.

More specifically, when the speed of the watercraft is high, the ISC valve is initially closed relatively slowly so that the engine speed is maintained at a relatively high speed. This is advantageous because, when the engine is engaged with the propeller in the forward drive condition and the watercraft is traveling at a high speed, the advancing force of the watercraft drives the propeller. Accordingly, the propeller shaft 126 and the driveshaft 120 are rotating at approximately the same speed. Thus, only a small load is being applied through the transmission 124 and only a relatively small force is required to disengaged the transmission. When the speed of the watercraft is low, the ISC valve is closed more quickly. Accordingly, the watercraft and the engine slows down more quickly and the transmission can be shifted into reverse or neutral more easily.

While the two illustrated arrangements use delays between sampling when the engine speed is above a preset engine speed to create two different closure rates, preprogrammed rates also can be used. For instance, a map or a set of maps may provide different closure rates depending upon watercraft/engine speed, either alone or in combination with other variables. Moreover, while sampling watercraft or engine speed may form a portion of the routine, such as those illustrated, a flag may be set by a separate routine that runs concurrently with the valve positioning routine. The flag can be used to indicate whether the currently sensed watercraft/engine speed is above the preset speed.

It should also be noted that the present invention can achieve the results described above while utilizing an inexpensive step motor to power the ISC valve. Such step motors typically work well even if salt deposits form on the ISC valve 82. In contrast, solenoid valves typically require more power to drive an ISC valve, especially if salt deposits have developed.

Although the present invention has been described in terms of certain preferred embodiments, other embodiments apparent to those of ordinary skill in the art also are within the scope of this invention. Thus, various changes and modifications may be made without departing from the spirit and scope of the invention. For instance, various components may be repositioned as desired and certain steps of the control routine can be combined, subdivided or interlaced with other operations. Moreover, not all of the features, aspects and advantages are necessarily required to practice the present invention. Accordingly, the scope of the present invention is intended to be defined only by the claims that follow.

What is claimed is:

1. An engine for a watercraft comprising a cylinder body, at least one cylinder bore being formed in the cylinder body, a piston being mounted for reciprocation within the cylinder bore, a cylinder head being disposed over a first end of the cylinder bore, a crankcase member being disposed over a second end of the cylinder bore, an output shaft being disposed at least partially within a crankcase chamber at least partially defined by the crankcase member, the output shaft powering an output device, a combustion chamber being defined at least partially within the cylinder bore between the cylinder head and the piston, an intake conduit communicating with the combustion chamber, a throttle valve being disposed within the intake conduit, a throttle valve sensor being capable of sensing a position of the throttle valve, a bypass passage communicating with the intake conduit at a location between the throttle valve and the combustion chamber, an idle speed control valve being disposed along the bypass passage, a speed sensor capable of deducing a traveling speed of the watercraft, a controller electrically communicating with the idle speed control valve, the speed sensor and the throttle valve sensor, the controller being adapted to close the idle speed control valve at a first rate when the watercraft is traveling at a speed greater than a preset value and the throttle valve is rapidly closed and to close the idle speed control valve at a second rate when the watercraft is traveling below the preset value and the throttle valve is rapidly closed.

2. The engine of claim 1, wherein the first rate is slower than the second rate.

3. The engine of claim 1, wherein the speed sensor comprises a engine speed sensor configured to sense an engine speed.

4. The engine of claim 1 further comprising a stepper motor drivingly connected to the idle speed control valve, wherein the controller electrically communicates with the idle speed control valve through the stepper motor.

5. The engine of claim 4, wherein the first rate is slower than the second rate.

6. The engine of claim 1 further comprising at least a second cylinder bore and a second combustion chamber, a second intake conduit communicating with the second combustion chamber and a second throttle valve disposed along the second intake conduit, the bypass passage communicating the second intake conduit at a location between the second throttle valve and the second combustion chamber, the bypass passage comprising a first branch that communicates with the intake conduit, a second branch that communicates with the second intake conduit and a main body that communicates with the first branch and the second branch, the idle speed control valve being positioned along the main body.

7. A method of controlling movement of an idle speed control valve, the method comprising the steps of detecting a throttle angle, sensing a position of the idle speed control valve, determining a target position of the idle speed control valve position, comparing the target position to the sensed position, sensing a speed of a watercraft, moving the idle speed control valve at a first rate if the target position and the sensed position differ and the speed of the watercraft is above a preset value and moving the idle speed control valve at a second rate if the target position and the sensed position differ and the speed of the watercraft is below the preset value.

8. The method of claim 7, wherein the first rate is greater than the second rate.

9. The method of claim 8, wherein the first rate is determined by a delay between contiguous movements of the idle speed control valve.

10. The method of claim 8, wherein the first rate is determined by intermittently pausing movement of the idle speed control valve.

11. The method of claim 7, further comprising determining if the idle speed control valve is moving in the closing direction and only moving the idle speed control valve at the first rate if the idle control valve is moving in the closing direction.

12. The method of claim 11, further comprising moving the idle speed control valve at the second rate if the idle speed control valve is not moving in the closing direction.

13. The method of claim 7, wherein the first rate is about double the second rate.

14. A method of controlling an idle speed control valve in an engine for a watercraft having an induction system with a throttle valve and a bypass passage in which the idle speed control valve is positioned, the method comprising the steps of sensing a throttle angle of the throttle valve, sensing a traveling speed of the watercraft, moving the idle speed control valve at a first rate if the traveling speed of the watercraft is above a preset value and moving the idle speed control valve at a second rate if the traveling speed of the watercraft is below the preset value.

15. The method of claim 14, wherein the movement of the idle speed control valve is toward a closed position.

16. The method of claim 14, wherein moving the idle speed control valve comprises actuating a stepper motor that is connected to the idle speed control valve.

17. The method of claim 16, wherein moving the idle speed control valve at the first rate comprises delaying actuating the stepper motor.

18. The method of claim 17, wherein delaying actuating the stepper motor comprises pausing between samples of the traveling speed or the throttle angle.

19. The method of claim 17, wherein delaying actuating the stepper motor occurs after the stepper motor has been actuated.

* * * * *